US009955788B1

(12) United States Patent
Montague

(10) Patent No.: US 9,955,788 B1
(45) Date of Patent: May 1, 2018

(54) ROPE ROCKING CHAIR

(71) Applicant: William Montague, Concord, MA (US)

(72) Inventor: William Montague, Concord, MA (US)

( * ) Notice: Subject to any disclaimer, the term of this patent is extended or adjusted under 35 U.S.C. 154(b) by 0 days. days.

(21) Appl. No.: 15/379,073

(22) Filed: Dec. 14, 2016

(51) Int. Cl.
*A47C 3/029* (2006.01)
*A47C 7/22* (2006.01)
*A47C 5/00* (2006.01)

(52) U.S. Cl.
CPC ..... *A47C 7/22* (2013.01); *A47C 3/029* (2013.01); *A47C 5/00* (2013.01)

(58) Field of Classification Search
CPC ..... A47C 7/22; A47C 3/029; A47C 5/00
See application file for complete search history.

(56) References Cited

U.S. PATENT DOCUMENTS 87,644 A * 3/1869 Daft
1,670,603 A * 5/1928 Weeks ..... A47C 3/029 297/131
4,192,547 A * 3/1980 Geier ..... A47C 3/029 297/271.5
4,818,021 A * 4/1989 Roysher ..... A47C 4/022 297/284.3
6,257,660 B1 * 7/2001 Calvey ..... A47C 3/029 297/16.1
8,141,944 B2 * 3/2012 Reeb ..... A47C 4/286 297/16.2
2006/0061195 A1 * 3/2006 Snyders ..... A47C 3/029 297/452.63

* cited by examiner

*Primary Examiner* — Philip F Gabler
(74) *Attorney, Agent, or Firm* — Duquette Law Group, LLC

(57) ABSTRACT

A rope rocking chair comprises at least two side panels, a brace members, rope members, armrests, and arcuate sections. The side panels are fixedly attached to each other via the brace members positioned substantially perpendicular to the at least two side panels and positioned apart by the brace members. The rope members are attached spatially apart to the side panels in a direction parallel to one of the brace members to provide a seating area. The armrest positioned at a middle section of each of the at least two side panels is provided for resting an arm of the user. The arcuate section configured at a lower section of each of the at least two side panels provides the back and forth rocking motion to the user seated on the seating area of the rope rocking chair.

10 Claims, 5 Drawing Sheets

ROPE ROCKING CHAIR

TECHNICAL FIELD OF THE INVENTION

The invention disclosed herein generally relates to rope rocking chair. More particularly, the invention relates to a rope rocking chair for seating a user and providing a back and forth rocking motion to the user, in which a seating area of the rope rocking chair is provided by a plurality of horizontal rope members.

BACKGROUND

Rocking chairs provide a gentle rocking back and forth motion to a seated user. This rocking motion is highly soothing and provides a stress relieving effect to individuals of all ages. Typically, rocking chairs have hard wooden seats. These seats pose difficulties to individuals having back problems. Such rocking chairs may require an additional soft cushion material to be attached to provide the user comfort while sitting. Furthermore, the seating area of existing rocking chairs are generally perpendicular and made of solid panels of materials, for example, wood, plastic, etc. This design creates discomfort among individuals with medical conditions ranging from mild back pain to severe body aches. A rocking chair, which provides a seating area conforming to the back and bottom of a user to provide comfort while sitting, is required. Moreover, conventional rocking chair designs make it difficult for elderly individuals to get up from without help. Others have long rockers sticking out from the front and the back, which one can cause users to trip and fall.

Existing rocking chairs are lounge rocking chairs where you sit back and rest your head. These are layback with a headrest so the neck of the user is not getting exercise. Additionally, rocking chairs are designed lower than non-rocking chairs to prevent blood from being shut off to your legs when you tip back. This design creates difficulty for aged individuals who may not be able to lift themselves up from the rocking chair. A rocking chair, which allows a user to easily dismount and does not pose a tripping hazard to a user, is required. Furthermore, users who are prone to be seated for long periods, for example, elderly individuals, writers, etc., or users who may perspire profusely undergo discomfort when the seating area is made of solid panels. A seating area of a rocking chair, which allows aeration of a back of a user, is required.

Hence, there is a long felt but unresolved need for a rocking chair, which provides a seating area conforming to the back and bottom of a user to provide comfort while sitting. Furthermore, there is a need for a rocking chair, which allows a user to easily dismount and does not pose a tripping hazard to a user. Moreover, there is a need for a seating area of a rocking chair, which allows aeration of a back of a user.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The rope rocking chair disclosed herein addresses the above-mentioned need for a rocking chair, which provides a seating area conforming to the back of a user to provide comfort while sitting. Furthermore, the invention addresses a need for a rocking chair, which allows a user to easily dismount and does not pose a tripping hazard to a user. Moreover, the invention addresses a need for a seating area of a rocking chair, which allows aeration of a back of a user. The rope rocking chair for seating a user and providing a back and forth rocking motion to the user comprises at least two side panels, a brace members, rope members, armrests, and arcuate sections. The side panels are fixedly attached to each other via the brace members positioned substantially perpendicular to the at least two side panels and positioned apart by the brace members. The rope members are attached spatially apart to the side panels in a direction parallel to the brace members to provide a seating area. The armrest positioned at a middle section of each of the at least two side panels is provided for resting an arm of the user. The arcuate section is configured at a lower section of each of the at least two side panels provides the back and forth rocking motion to the user seated on the seating area of the rope rocking chair.

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and structures disclosed herein. The description of a method step or a structure referenced by a numeral in a drawing is applicable to the description of that method step or structure shown by that same numeral in any subsequent drawing herein.

DETAILED DESCRIPTION OF THE INVENTION

Figure 1:
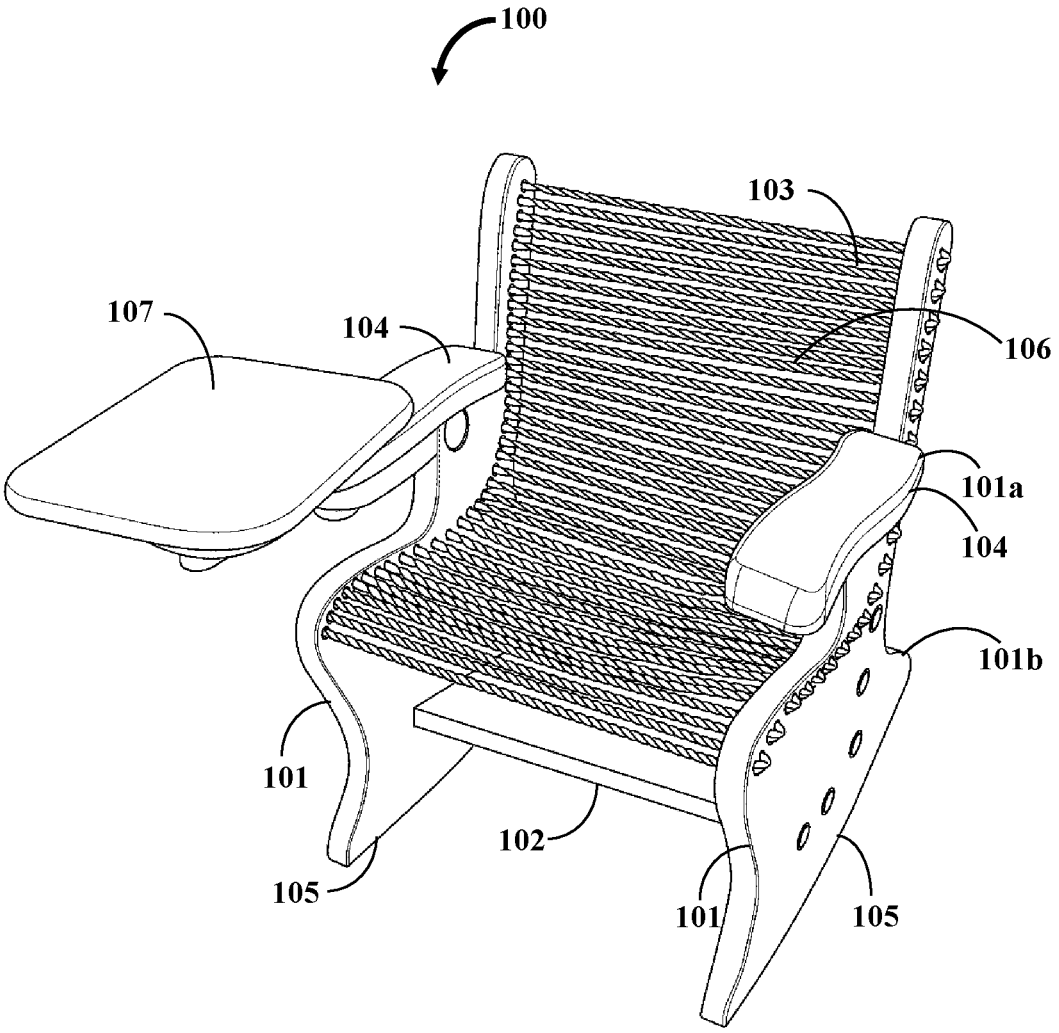
FIG. 1 exemplarily illustrates a top perspective view of a rope rocking chair.

FIG. 1 exemplarily illustrates a top perspective view of a rope rocking chair 100. The rope rocking chair 100 for seating a user and providing a back and forth rocking motion to the user comprises at least two side panels 101, brace members 102, rope members 103, armrests 104, and arcuate sections 105. The side panels 101 are fixedly attached to each other via the brace members 102. The brace members 102 are positioned substantially perpendicular to the side panels 101 and the side panels 101 are positioned apart by the brace members 102. The rope members 103 are attached spatially apart to the side panels 101 in a direction parallel to the brace members 102 to provide a seating area 106. In an embodiment, the brace members 102 function as a shelf. The shelf is about 10-inches deep and about 19.75-inches wide. In the embodiment, a rear brace member 102 is positioned perpendicular to the brace member 102 to function as a closed shelf to keep stored objects from falling off the rear of the shelf. The armrests 104 are positioned at a middle section 101*a* of each of the side panels 101 for resting an arm of the user. The arcuate section 105 is configured at a lower section 101*b* of each of the side panels 101. The arcuate section 105 provides back and forth rocking motion to the user seated on the seating area 106 of the rope rocking chair 100. In an embodiment, the rope rocking chair 100 also comprises a detachable swiveling desk 107 detachably attached to one of the armrests 104 of the rope rocking chair 100 for providing a work surface to the user.

In an embodiment, the at least two side panels 101 are made of a wooden material. Moreover, the brace members 102 are made of a wooden material. The seating area 106 conforms to a back and bottom of a user. Since the flexible rope members 103 support the body of the user, the rope rocking chair 100 provides additional comfort to the user. The placement of each strand of the rope member 103 is positioned so that it follows the contour of the user's body. Each rope supports the user's body evenly. There are no high-pressure points. The result is that the user is not aware of where his/her body being supported. However, the body of the user is supported evenly. In an embodiment, the dimensions are, for example, 32-inch high and 26-inch front to back. The overall width at the armrests 104 is about 26.5-inches. In an embodiment, the rope rocking chair 100 weighs about 45 pounds. In an embodiment, the wood used is cherry. The rope members 103 are made of, for example, a 0.5-inch polypropylene material, etc. Furthermore, the rope rocking chair 100 is finished with Danish oil finish.

Figure 2:
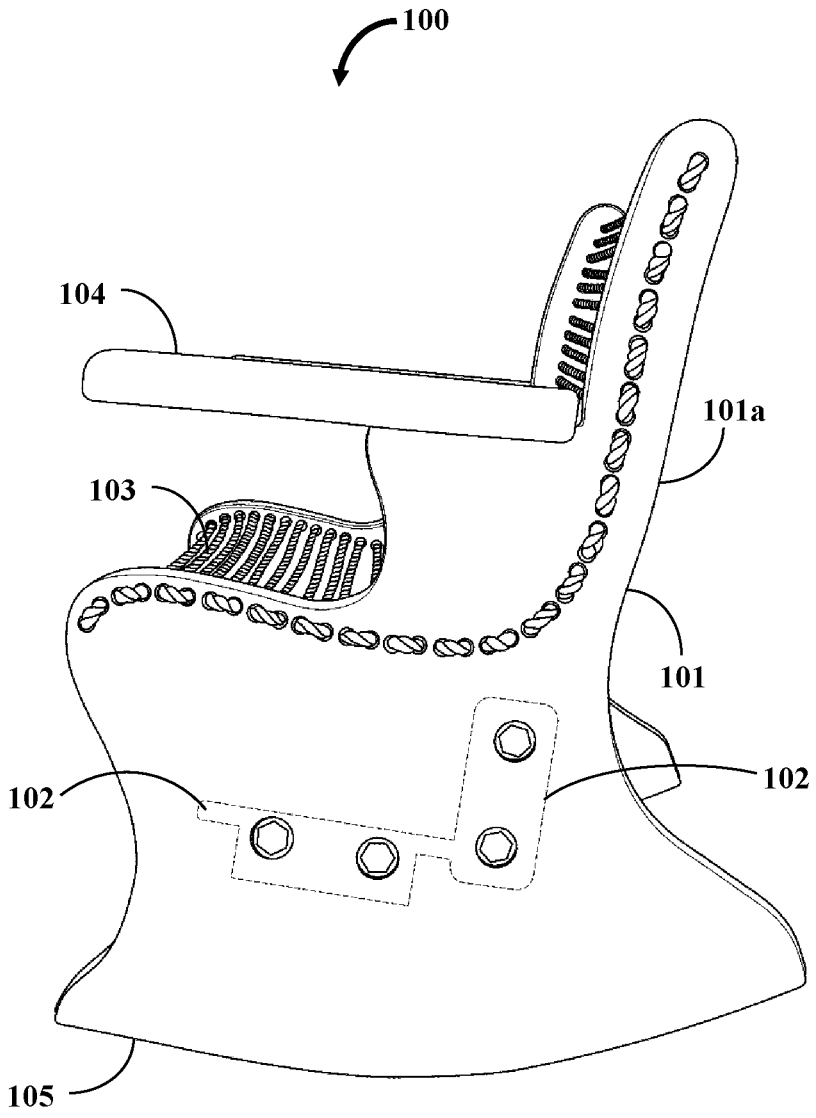
FIG. 2 exemplarily illustrates a left side perspective view of a rope rocking chair.

FIG. 2 exemplarily illustrates a left side perspective view of a rope rocking chair 100. The rope rocking chair 100 is designed to be easy to get out of by a user. When a seated user leans forward, the rope rocking chair 100 comes to a stop. The rope rocking chair 100 is then stable. The user then placing both feet under the rope rocking chair 100, with the user's hands placed on the front part of each armrest 104; lifts himself/herself up using both their arms and legs. In an embodiment, the rope rocking chair 100 has finger grooves under the front of each armrest 104, which allows the user to pull the rope rocking chair 100 forward with ease in a standing position. In an embodiment, the brace members 102 are positioned perpendicular to each other to form the shelf as exemplarily illustrated in FIG. 2. The rope rocking chair 100 is small and compact and does not contain long pieces of wood sticking out in the front or rear. Only six pieces are required to make up the entire rope rocking chair 100. The arcuate section 105 allows the user to lean forward to ensure the rope rocking chair 100 is stable. Additionally, this ensures that a user can then place their feet under themselves and lift themselves up easily by placing both hands on the front part of the armrests 104. This feature is particularly useful for elderly users suffering from health problems, for example, arthritis, back pain, weak legs, etc. In an embodiment, a deep finger groove is provided under each armrest 104. This allows the user to pull the rope rocking chair 100 forward when standing up in front of the rope rocking chair 100.

Figure 3:
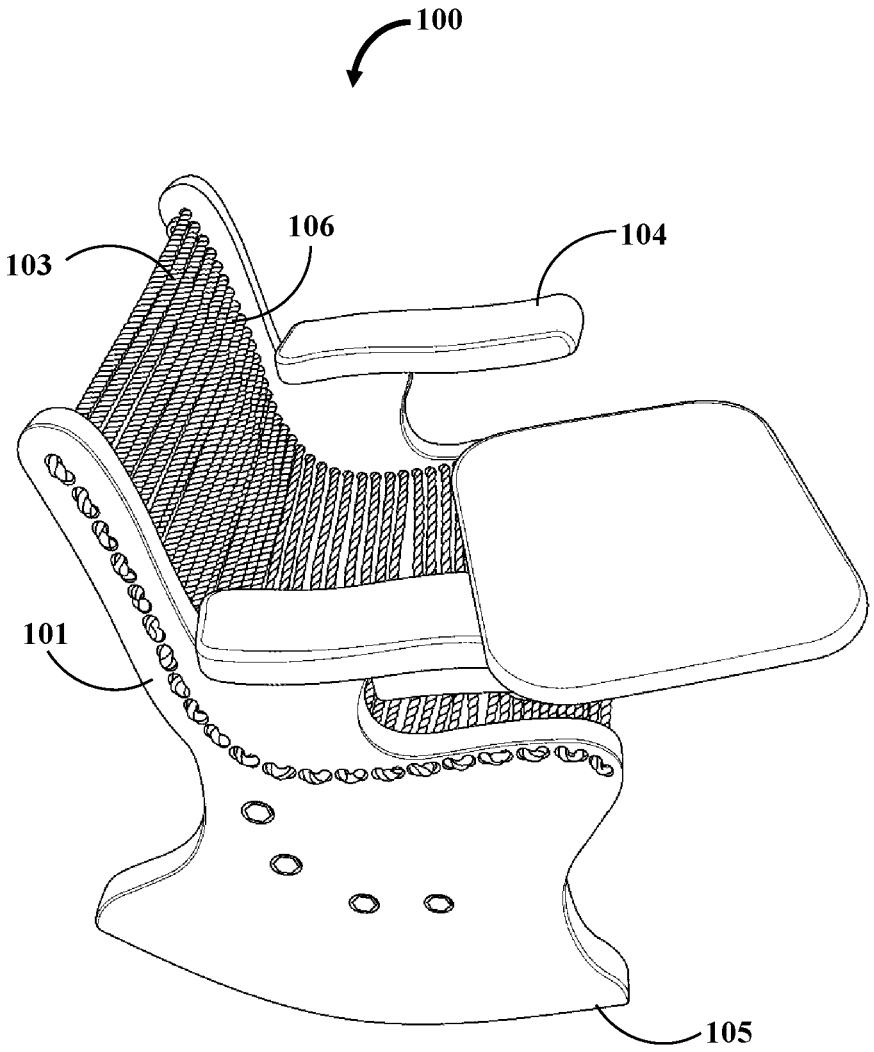
FIG. 3 exemplarily illustrates a right side perspective view of a rope rocking chair.

FIG. 3 exemplarily illustrates a right side perspective view of a rope rocking chair 100. In an embodiment, the seating area 106 of the rope rocking chair 100 comprises an open rope design. This provides aeration to the back of the user seated on the seating area 106 of the rope rocking chair 100. This feature adds comfort for users who perspire profusely or users who are prone to be seated for prolonged periods. The open rope design allows the body of the user space to exchange heat with the surrounding air. Furthermore, the rope members 103 are not held taut between the side panels 101 of the rope rocking chair 100. This allows the seating area 106 created by the multiple rope members 103 to conform to the back and the bottom of a user. This feature of the rope rocking chair 100 supports user's backs in just the right place. Moreover, the seating area 106 is not configured in a substantially perpendicular orientation. The rope members 103 are positioned to conform to the contour of a back and a bottom of a seated user.

Figure 4:
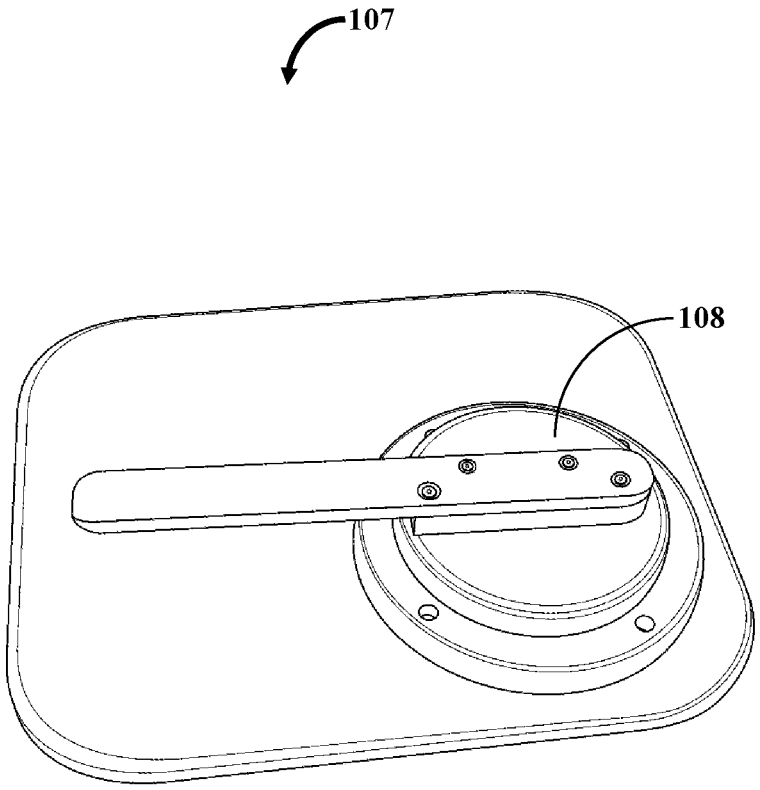
FIG. 4 exemplarily illustrates a bottom perspective view of a detachable swiveling desk.

FIG. 4 exemplarily illustrates a bottom perspective view of a detachable swiveling desk 107. In an embodiment, the detachable swiveling desk 107 slips under the right armrest 104 of the rope rocking chair 100 into a recess. In an embodiment, the detachable swiveling desk 107 comprises a knob 108 below the armrest 104 that can be tightened to prevent the detachable swiveling desk 107 from moving. The detachable swiveling desk 107 itself is on a swivel base so it can be turned to any position that is comfortable. The detachable swiveling desk 107 is used for various applications, for example, writing, placing a laptop computer, placing a tablet or other electronic device, etc. In an embodiment, the detachable swiveling desk 107 is capable of swiveling 360° and is adjustable to an inclination a user finds comfortable. The detachable swiveling desk 107 can also be removed by loosening the knob 108 below the armrest 104, exemplarily illustrated in FIGS. 1-3, and the detachable swiveling desk 107 is removed.

Figure 5:
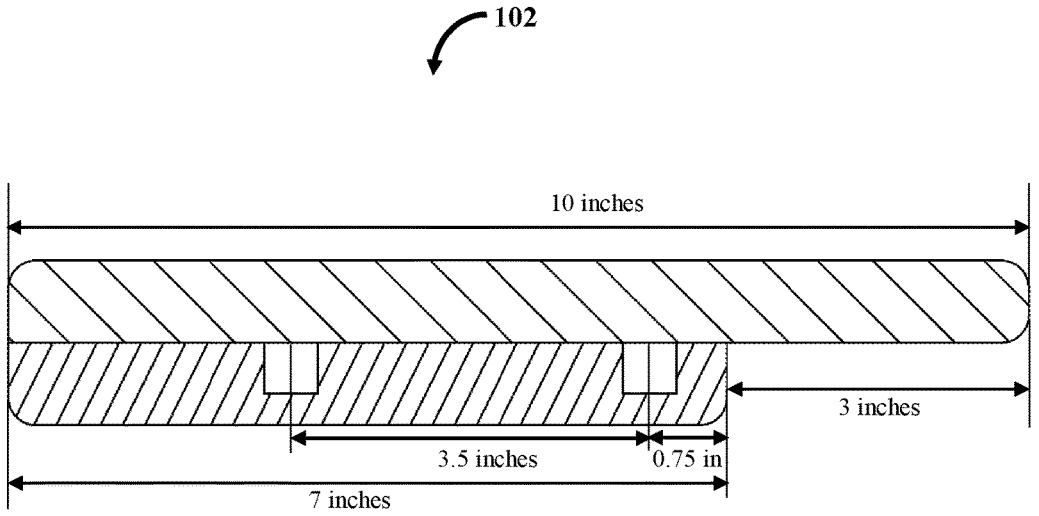
FIG. 5 exemplarily illustrates a sectional view of a brace member of a rope rocking chair.

FIG. 5 exemplarily illustrates a sectional view of a brace member 102 of a rope rocking chair 100. In an embodiment, brace members 102 are positioned perpendicular to each other to form a shelf as exemplarily illustrated in FIG. 2. In an embodiment, the brace member 102 is attached to the rope rocking chair 100 via at least two fasteners. The second brace member 102 is in the vertical position and acts as a rear end of the shelf. This prevents items placed in the shelf from falling off the rear end when rocking back and forth. When the rope rocking chair 100 is all the way forward, the shelf is level. When the rope rocking chair 100 is in the normal position, the shelf is slanted back to keep items from falling off the front of the shelf. In an embodiment, the brace member 102 has an overall length of 19.75 inches. The dimensions of the brace member 102 are as exemplarily illustrated in FIG. 5. In an embodiment, the rope rocking chair 100 is used as a rehabilitation assistance tool. The rope rocking chair 100, by virtue of its rocking motion, is used to alleviate conditions, for example, chronic back pain, anxiety, tension, depression, dizziness, etc. In another embodiment, the rope rocking chair 100 is used to rehabilitate patients post-surgery.

The foregoing examples have been provided merely for the purpose of explanation and are in no way to be construed as limiting of the rope rocking chair 100, disclosed herein. While the rope rocking chair 100 has been described with reference to various embodiments, it is understood that the words, which have been used herein, are words of description and illustration, rather than words of limitation. Further, although the rope rocking chair 100, has been described herein with reference to particular means, materials, and embodiments, the rope rocking chair 100 is not intended to be limited to the particulars disclosed herein; rather, the rope rocking chair 100 extends to all functionally equivalent structures, methods and uses, such as are within the scope of the appended claims. Those skilled in the art, having the benefit of the teachings of this specification, may effect numerous modifications thereto and changes may be made without departing from the scope and spirit of the rope rocking chair 100 disclosed herein in their aspects.

What is claimed is:

1. A rocking chair for seating a user and providing a back and forth rocking motion to the user, the rocking chair comprising:

at least two side panels fixedly attached to each other via brace members positioned substantially perpendicular to the at least two side panels, the at least two side panels positioned apart by the brace members;

a plurality of rope members attached spatially apart to the at least two side panels in a direction parallel to one of the brace member to provide a seating area, the plurality of rope members defining a support surface for directly supporting the user;

an armrest positioned at a middle section of each of the at least two side panels for resting an arm of the user; and an arcuate section configured at a lower section of each of the at least two side panels, wherein the arcuate section provides the back and forth rocking motion to the user seated on the seating area of the rocking chair, and wherein the arcuate section of each of the at least two side panels defines a stop portion disposed at a forward location of the rocking chair, the stop portion configured to stop the back and forth rocking motion of the rocking chair when the rocking chair is disposed in a forward position.

2. The rocking chair of claim 1, further comprising at least one detachable swiveling desk detachably attached to one of the armrests of the rocking chair for providing a work surface to the user.

3. The rocking chair claim 1, wherein the at least two side panels are of wooden material.

4. The rocking chair claim 1, wherein the brace members are of a wooden material.

5. The rocking chair of claim 1, wherein the seating area conforms to a back of a user.

6. The rocking chair of claim 1, wherein the rope members are of a polypropylene material.

7. The rocking chair of claim 1, wherein the at least two side panels and the brace member define an opening at a forward position of the rocking chair, the opening configured to contain a lower leg portion of the user when the rocking chair is disposed in a forward position.

8. The rocking chair of claim 1, wherein the at least two side panels define a first S-shaped contour for a leg support portion of the seating area and a second S-shaped contour for a back support portion of the seating area along a plane substantially perpendicular to a longitudinal axis of the ropes.

9. The rocking chair of claim 1, wherein the arcuate section of each of the at least two side panels defines a stop portion disposed at a rearward location of the rocking chair, the stop portion configured to stop the back and forth rocking motion of the rocking chair when the rocking chair is disposed in a rearward position.

10. The rocking chair of claim 1, wherein each armrest of the at least two side panels defines a finger groove on an underside of a front portion of each armrest.

* * * * *